US011819103B1

(12) United States Patent
Stern et al.

(10) Patent No.: US 11,819,103 B1
(45) Date of Patent: Nov. 21, 2023

(54) CONTAINER FOR STORING AND CONSUMING A FOOD PRODUCT

(71) Applicant: Cardinal Creations Inc

(72) Inventors: Menachem Stern, Monsey, NY (US); Benjamin Weber, Spring Valley, NY (US); Michael Nellini, Ridgewood, NY (US)

( * ) Notice: Subject to any disclaimer, the term of this patent is extended or adjusted under 35 U.S.C. 154(b) by 0 days.

(21) Appl. No.: 17/941,527

(22) Filed: Sep. 9, 2022

(51) Int. Cl.
*A45C 7/00* (2006.01)
*A45C 11/20* (2006.01)

(52) U.S. Cl.
CPC ..... *A45C 7/0022* (2013.01); *A45C 11/20* (2013.01)

(58) Field of Classification Search
CPC ..... A45C 7/0036; A45C 7/00; A45C 7/0059; A45C 7/0077; A45C 7/0022; A45C 11/20
See application file for complete search history.

(56) References Cited

U.S. PATENT DOCUMENTS 4,953,673 A * 9/1990 Ambasz ..... A45C 7/0022 190/103
5,251,731 A * 10/1993 Cassese ..... A45C 7/0036 190/103
9,578,938 B1 * 2/2017 Verneuille ..... A45C 7/00
2013/0206800 A1 * 8/2013 Simonsen ..... A45C 7/0022 224/148.1

FOREIGN PATENT DOCUMENTS

WO WO-2012140479 A1 * 10/2012 ..... A45C 7/0018
WO WO-2016112421 A1 * 7/2016 ..... A45C 11/20

* cited by examiner

*Primary Examiner* — Javier A Pagan

(57) ABSTRACT

A container and a method for storing and consuming a food product are disclosed. The container includes a base. The container includes first accordion-pleated extending from the base and forming an interior with the base. The container includes second accordion-pleated walls extending from the first accordion-pleated walls. The second accordion-pleated walls form an opening. The first accordion-pleated walls and the second accordion-pleated walls expand or collapse under the action of a substantial force. The first accordion-pleated walls receive a food product into the interior through the opening. The first accordion-pleated walls expand or collapse while storing the food product in the interior and the second accordion-pleated walls expand to retain the food product within the interior. The second accordion-pleated walls collapse, and the first accordion-pleated walls collapse under the action of the substantial force to push the food product for consumption by a user through the opening from the interior. The second accordion-pleated walls include handles for transporting the container.

20 Claims, 8 Drawing Sheets

CONTAINER FOR STORING AND CONSUMING A FOOD PRODUCT

FIELD OF THE INVENTION

The present invention generally relates to containers. More particularly, the present invention relates to a container for storing a food product and facilitating ease of eating the food product straight out of the container while keeping the hands clean.

DESCRIPTION OF THE RELATED ART

It is known that containers or packaging units are used for storing and/or transporting food products and/or non-food products. Typically, the containers include a rigid structure with an opening and a cap or lid to cover the opening. The containers take up a lot of space due to their rigid structure. In order to consume the food product, a user has to take out the food products. At the time of consuming the food product, there is a chance of the food product falling off the container and/or drippings of the food product falling on the user's clothes. This presents an unpleasant experience for the user.

In order to overcome the problem of containers taking up space, several containers or packaging units have been proposed in the past. One such example is disclosed in a United States Patent Publication no. 20100203199, entitled "Packaged Salad" ("the '199 Publication"). The '199 Publication discloses a packaged salad that includes an undressed salad comprising a plurality of solid food items, and a package containing the salad. The package has a smaller distribution mode and a larger, expanded consumption mode. One or more air vents allow air to enter the package to prevent negative air pressure from impeding a user from expanding the package from distribution mode to consumption mode.

Another example is disclosed in a PCT Publication no. 2021059070 entitled "Expandable packaging and packaging container, procedure of its use and procedure for its manufacturing" ("the '070 Publication"). The '070 Publication discloses an expandable packaging container which comprises a bottom (2), a top (3) and a container side wall (5) wherein said container side wall (5) comprises a folded part (6) consisting of at least one or more flexible stretchable folds. The folds run at an angle from and including 90° to and including 40° with respect to the vertical of the container and are compressed together by folding together in the stage of packaging, storage, transport, distribution, delivery and/or sale. The folds stretch in the vertical direction of the container so that the volume of the packaging container is increased.

Although the disclosure presented above, and other similar disclosures that are known are useful in providing the required extra space for use, they have several problems. This is because; the disclosures of the above type do not solve the problem of food product falling off the container and/or drippings of the food product falling on the user's clothes during the use. Further, the packaging units are not easy to transport as they require an additional bag or a container to carry them.

Other documents describing the closest subject matter provide for a number of more or less complicated features that fail to solve the problem in an efficient and economical way. None of these patents suggest the novel features of the present invention. Specifically, none of the disclosures in the art disclose a container that can store a food product and facilitate ease of eating.

Therefore, there is a need in the art for a container for storing a food product and facilitating ease of eating the food product straight out of the container while keeping the hands clean.

SUMMARY

It is one of the main objects of the present invention to provide a container or package box or food box and that avoids the drawbacks of the prior art.

It is another object of the present invention to provide a container or package box or food box for storing a food product and facilitating ease of eating the food product straight out of the container while keeping the hands clean.

It is another object of the present invention to provide a container that is easy to grasp while consuming the food product.

It is yet another object of the present invention to provide a container that ensures the hands of a user and clothing are clean, can be selectively opened to the best size for eating cleanly, can be held with one hand, holds the food item together can be resealable.

In order to overcome the limitations here stated, the present invention provides a container for storing and consuming a food product. The container includes a base. The container includes first accordion-pleated extending from the base and forming an interior with the base. The first accordion-pleated walls include a series of ridges and troughs to collapse and expand the first accordion-pleated walls. The first accordion-pleated walls form a substantially rectangular configuration. The first accordion-pleated walls expand or collapse under the action of a substantial force on the first accordion-pleated walls.

The container includes second accordion-pleated walls extending from the first accordion-pleated walls. The second accordion-pleated walls form a substantially semi-circular configuration. The second accordion-pleated walls comprise ridges and troughs to collapse and expand the second accordion-pleated walls. The second accordion-pleated walls include an opening. The second accordion-pleated walls expand or collapse under the action of a substantial force on the second accordion-pleated walls.

The first accordion-pleated walls receive a food product into the interior through the opening. The first accordion-pleated walls expand or collapse while storing the food product in the interior, and the second accordion-pleated walls expand to retain the food product within the interior. The second accordion-pleated walls collapse, and the first accordion-pleated walls collapse under the action of the substantial force to push the food product through the opening from the interior for consumption by a user. The second accordion-pleated walls include handles for transporting the container.

The second accordion-pleated walls include handles. The handles extend from the second accordion-pleated walls and allow transport of the container. The handles further include a removable liner. The handles help to hold and hang the container/package box and work as a closure that can be resealable and reusable using sticky material known in the art that can be opened and closed.

In one advantageous feature of the present invention, the container allows the user to hold it from outside without touching the food product. This ensures the food product is held firmly within the container and helps the user to keep his/her hands clean (and prevent the germs from coming in contact with the user's hands).

In another advantageous feature of the present invention, the second accordion-pleated walls i.e., the top semi-circular accordion opens to expose the minimum area needed to consume the food product. The first accordion-pleated walls i.e., the bottom accordion collects crumbs and drips as the food product is being consumed by the user. In one example, the container includes a center blade for additional support on the food product.

In another advantageous feature of the present invention, the container helps to hold the food product and prevents it from falling apart while carrying it around. The container allows the food product to be eaten straight out of the package box or the container in an easy manner. The container helps the user to hold it using one or both hands. Additionally, the container acts as a package box that can be used to catch drippings from the food product when the user is consuming the food product.

In yet another advantageous feature of the present invention, the container allows storage or package of a food product. Further, the container allows the user to consume the food product on the go without the user coming in contact with his/her hands.

Features and advantages of the invention hereof will become more apparent in light of the following detailed description of selected embodiments, as illustrated in the accompanying FIGUREs. As will be realized, the invention disclosed is capable of modifications in various respects, all without departing from the scope of the invention. Accordingly, the drawings and the description are to be regarded as illustrative in nature.

BRIEF DESCRIPTION OF THE DRAWINGS

With the above and other related objects in view, the invention consists of the details of construction and combination of parts as will be more fully understood from the following description, when read in conjunction with the accompanying drawings in which.

DESCRIPTION OF THE EMBODIMENTS OF THE INVENTION

Figure 1:
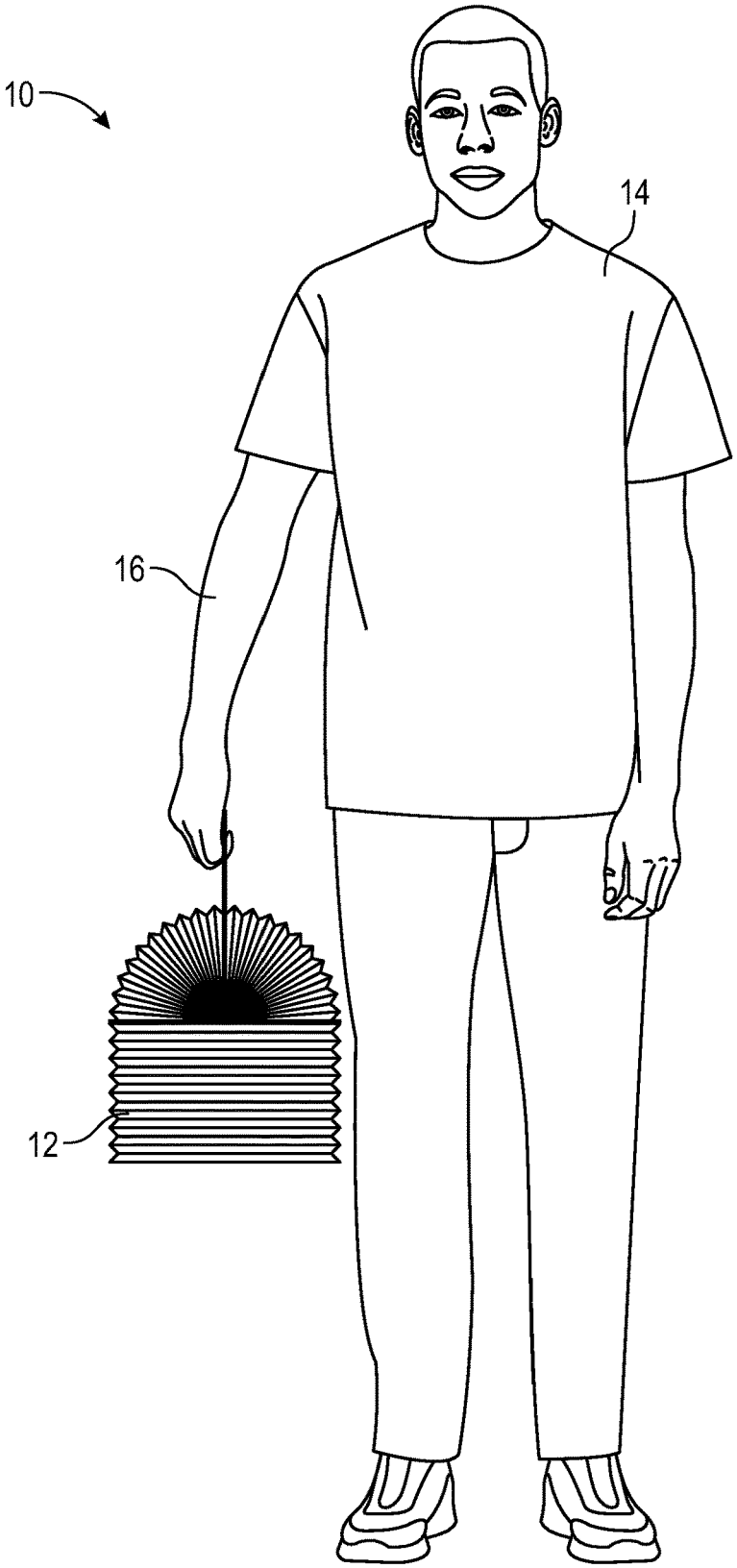
FIG. 1 illustrates an environment of a container, in accordance with one exemplary embodiment of the present invention.

The following detailed description set forth below in connection with the appended drawings is intended as a description of exemplary embodiments in which the presently disclosed invention may be practiced. The term "exemplary" used throughout this description means "serving as an example, instance, or illustration," and should not necessarily be construed as preferred or advantageous over other embodiments. The detailed description includes specific details for providing a thorough understanding of the presently disclosed container. However, it will be apparent to those skilled in the art that the presently disclosed invention may be practiced without these specific details. In some instances, well-known structures and devices are shown in functional or conceptual diagram form in order to avoid obscuring the concepts of the presently disclosed container.

In the present specification, an embodiment showing a singular component should not be considered limiting. Rather, the invention preferably encompasses other embodiments including a plurality of the same component, and vice-versa, unless explicitly stated otherwise herein. Moreover, the applicant does not intend for any term in the specification to be ascribed an uncommon or special meaning unless explicitly set forth as such. Further, the present invention encompasses present and future known equivalents to the known components referred to herein by way of illustration.

Although the present invention provides a description of a container, it is to be further understood that numerous changes may arise in the details of the embodiments of the container. It is contemplated that all such changes and additional embodiments are within the spirit and true scope of this disclosure.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure.

The present invention discloses a container and a method for storing and consuming a food product. The container includes a base. The container includes first accordion-pleated extending from the base and forming an interior with the base. The container includes second accordion-pleated walls extending from the first accordion-pleated walls. The second accordion-pleated walls form an opening. The first accordion-pleated walls and the second accordion-pleated walls expand or collapse under the action of a substantial force. The first accordion-pleated walls receive a food product into the interior through the opening. The first accordion-pleated walls expand or collapse while storing the food product in the interior and the second accordion-pleated walls expand to retain the food product within the interior. The second accordion-pleated walls collapse, and the first accordion-pleated walls collapse under the action of the substantial force to push the food product for consumption by a user through the opening from the interior. The second accordion-pleated walls may include handles for transporting the container.

Various features and embodiments of a container for storing and consuming a food product are explained in conjunction with the description of FIGS. 1-11.

FIG. 1 shows an environment 10 of a container or package box or food box 12 for storing and transporting a food product, in accordance with one exemplary embodiment of the present invention. As can be seen, a user 14 holds container 12 with his/her hand 16 when not in use to transport container 12 from one location to another.

FIGS. 2A, 2B, 2C and 2D show a perspective view, a top view, a side view and a front view, respectively, of container 12, in accordance with one embodiment of the present invention. Container 12 presents a first end 20, a second end 22, sides 24, a top end 26 and a bottom end 28. First end 20 indicates a front end or front side of container 12. Second end 22 indicates a rear end or rear side of container 12. Sides 24 indicate a left and/or a right side of container 12. Further, top end 26 indicates a top side or top portion of container 12. Bottom end 28 indicates a bottom side or bottom portion of container 12.

Container 12 includes a base 30. In one example, base 30 comes in a flat and rectangular configuration. Base 30 is made of metal, paper, vellum, plastic, wood or any other suitable material that may contain liquids and oils. It is preferable to provide base 30 in a rigid configuration to prevent it from bending. Container 12 encompasses first accordion-pleated walls 31. First accordion-pleated walls 31 is made of paper, vellum, plastic, high density polyethylene (HDPE), polypropylene (PP), rubber or any other suitable and/or flexible material. First accordion-pleated walls 31 extend from each side of base 30 towards top end 26 forming a rectangular configuration, as shown in at least FIGS. 2A, 2C and 2D or any other suitable shape such as circular, not shown. First accordion-pleated walls 31 indicate upstanding sidewalls extending from base 30. In other words, first accordion-pleated walls 31 indicate concertinaed sidewalls extending from base 30. First accordion-pleated walls 31 include a series of ridges 32 and troughs 33 positioned adjacent to each other. Ridges 32 and troughs 33 allow a substantially vertical expansion and/or collapse of first accordion-pleated walls 31 under the action of a substantially vertical force on first accordion-pleated walls 31. In other words, the series of ridges 32 and troughs 33 allow folding and expansion of first accordion-pleated walls 31. Ridges 32 may be spaced apart equally. Similarly, troughs 33 may be spaced apart equally. In one example, ridges 32 are spaced apart at a distance of 0.27 centimeter and troughs 33 are spaced apart at a distance of 0.27 centimeter. First accordion-pleated walls 31 are provided with a suitable thickness depending on the need.

Container 12 further includes second accordion-pleated walls 32. Second accordion-pleated walls 34 are made of paper, vellum, plastic, high density polyethylene (HDPE), polypropylene (PP), rubber or any other suitable and/or flexible material that can be leak proof, and contain oils, liquids, crumbs, and heat or cold.

Figure 2A:
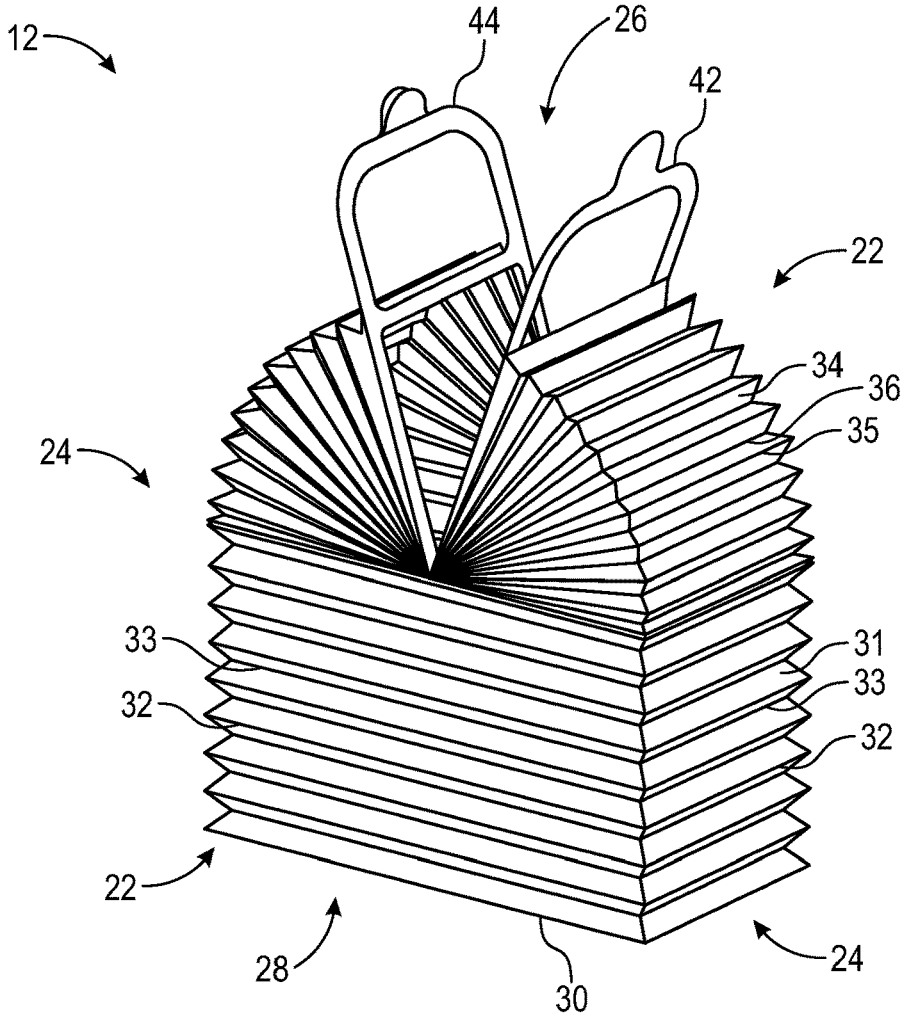
FIGS. 2A, 2B, 2C and 2D illustrate a perspective view, a top view, a side view and a front view, respectively, of the container, in accordance with one embodiment of the present invention.
Figure 2B:
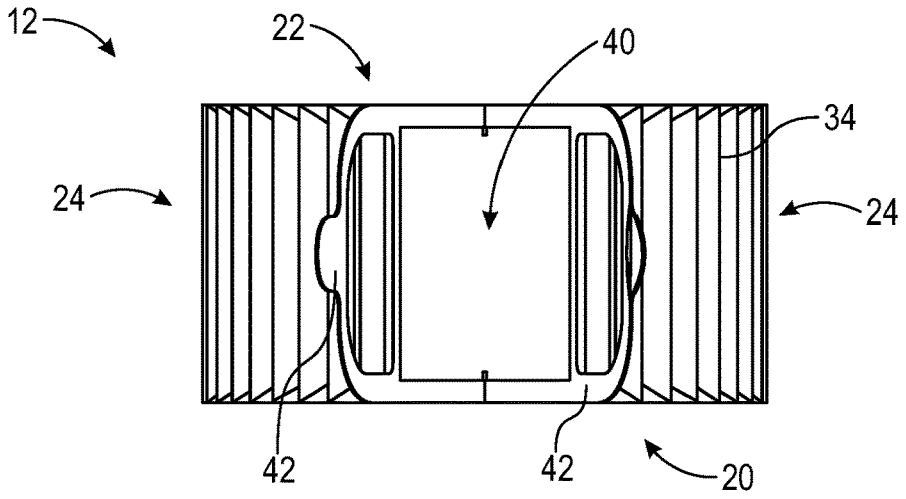
Figure 2C:
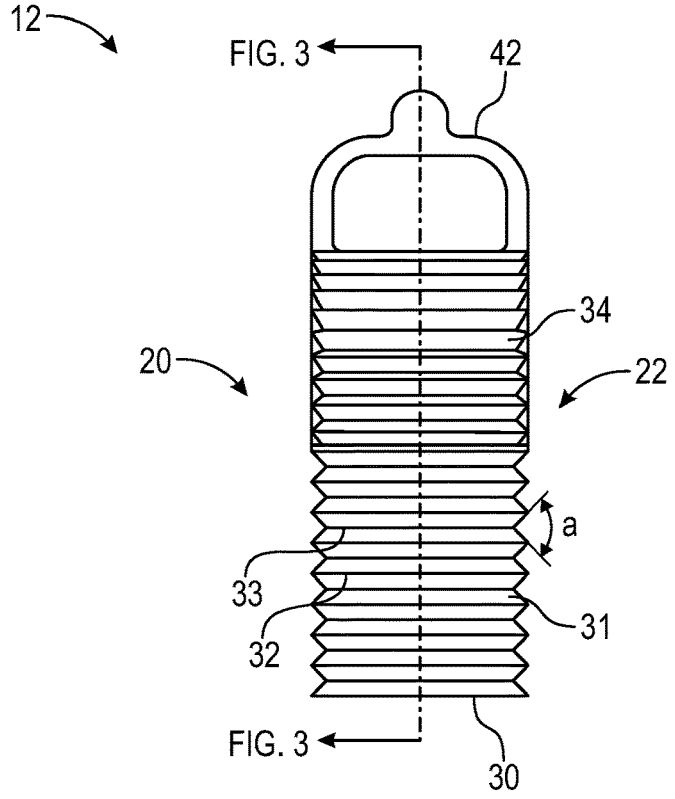
Figure 2D:
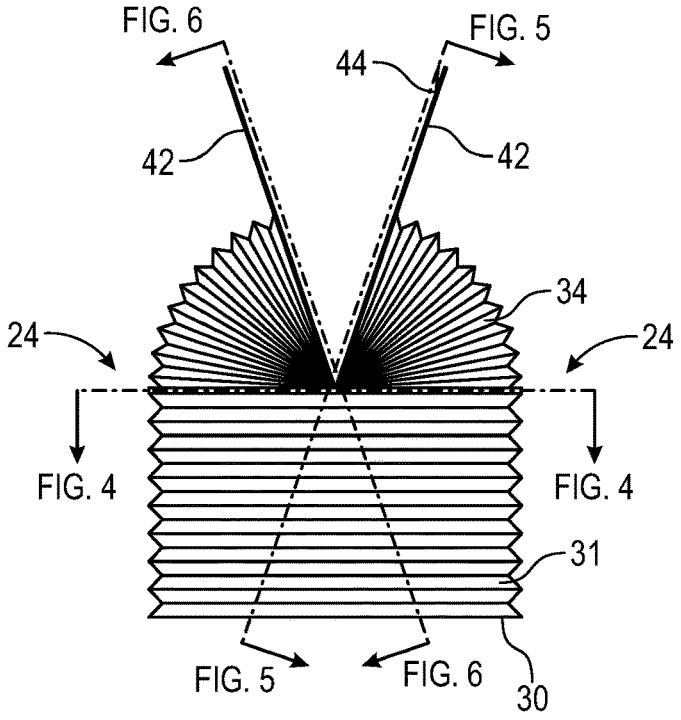

Second accordion-pleated walls 32 extend from the top of first accordion-pleated walls 31 in a substantially semi-circular configuration, as shown in at least FIGS. 2A and 2D. Similar to first accordion-pleated walls 31, second accordion-pleated walls 34 include a series of ridges 35 and troughs 36 positioned adjacent to each other. Ridges 35 and troughs 36 allow a substantially expansion and/or collapse of second accordion-pleated walls 34 under the action of a substantial force on second accordion-pleated walls 34. In other words, the series of ridges 35 and troughs 36 allow folding and expansion of second accordion-pleated walls 34. Ridges 35 are spaced apart equally. Similarly, troughs 36 are spaced apart equally. In one example, the distance between ridges 35 are spaced apart at a distance of 0.27 centimeter and troughs 36 are spaced apart at a distance of 0.27 centimeter. Second accordion-pleated walls 34 are provided with suitable thickness depending on the need. In one example, adjacent ridge 35 and trough 36 is positioned at an angle a of about 90 degrees as shown in FIG. 2C.

In one embodiment, each of first accordion-pleated walls 31 and second accordion-pleated walls 34 include a rim (not shown). The rim surrounds first accordion-pleated walls 31 and second accordion-pleated walls 34 and helps to catch drippings from the food product.

Figure 3:
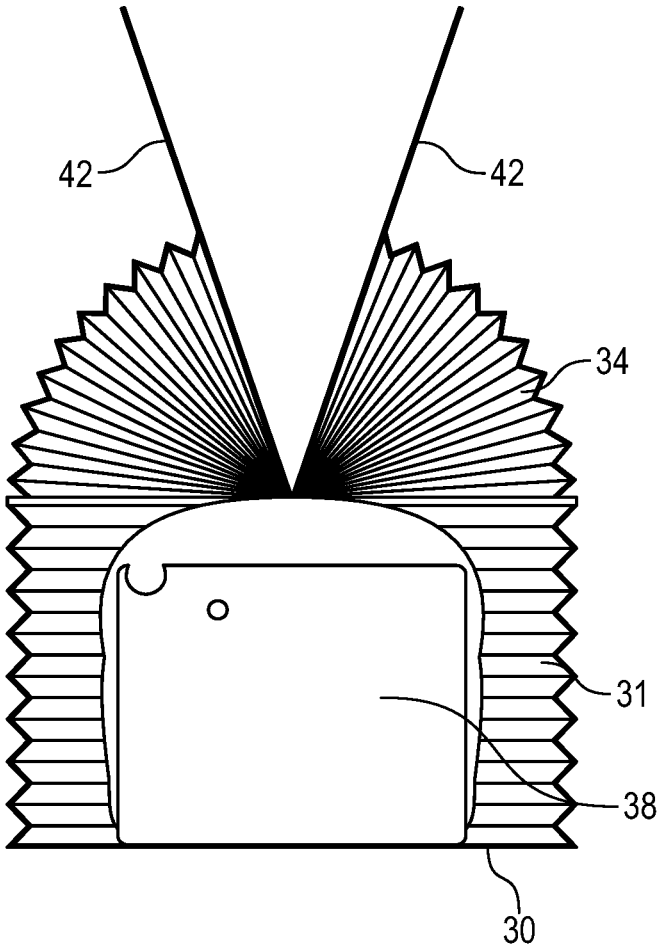
FIG. 3 illustrates a cross-sectional side view of the container having an interior, in accordance with one embodiment of the present invention.
Figure 4:
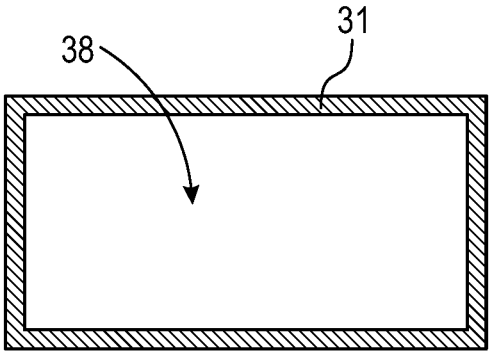
FIG. 4 illustrates a cross-sectional of first accordion-pleated walls, in accordance with one embodiment of the present invention.

Base 30 and upstanding first accordion-pleated walls 31 form an interior 38 for storing food product(s). FIG. 3 shows a cross-sectional side view of container 12 having interior 38. Further, FIG. 4 shows a cross-sectional of first accordion-pleated walls 31 having interior 38. Interior 38 of container 12 is accessible by an opening 40 formed at the middle or center of second accordion-pleated walls 34, as shown in FIG. 2B. In accordance with the present embodiment, user 14 places the food product into interior 38 through opening 40. Further, user 14 consumes or removes the food product from interior 38 through opening 40.

Figure 5:
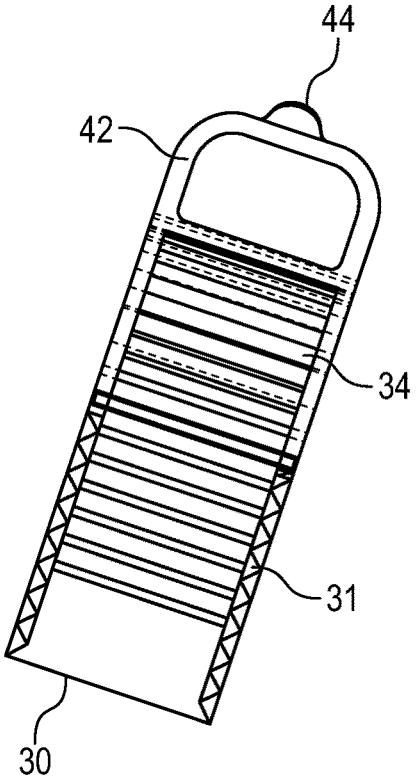
FIGS. 5 and 6 illustrate cross-sectional views of the container having handles at second accordion-pleated walls, in accordance with one embodiment of the present invention.
Figure 6:
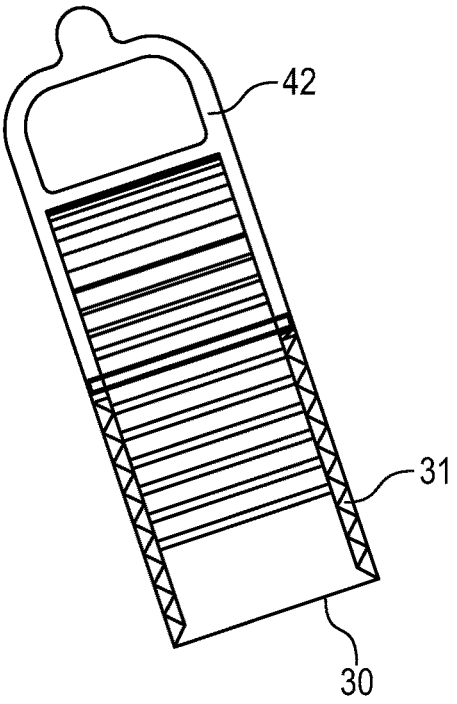

Further, container 12 may include handles 42 at the distal end of second accordion-pleated walls 34 as shown in FIGS. 2A, 2B, 2C and 2D. FIGS. 5 and 6 show cross-sectional views of container 12 having handles 42 at second accordion-pleated walls 34, in accordance with one embodiment of the present invention. Handles 42 are made of metal, plastic, paper, or any other suitable material. Handles 42 extend from second accordion-pleated walls 34 toward top end 26. Handles 42 come in a suitable length to connect container 12 to a variety of objects such as vehicles or hooks when not in use. Handles 42 connect to second accordion-pleated walls 34 using known connecting mechanisms. Connecting mechanisms include, but not limited to, adhesive strip or tape, hook and loops, fastener, among others. In one exemplary embodiment, each of handles 42 encompasses a liner 44. Liner 44 removably connects to handle 42. Liner 44 is made of paper, fabric or any other suitable material. Liner 44 is provided to easily peel or remove from handle 42 and dispose of after use or when it gets dirty from stains caused by the food products.

Figure 7:
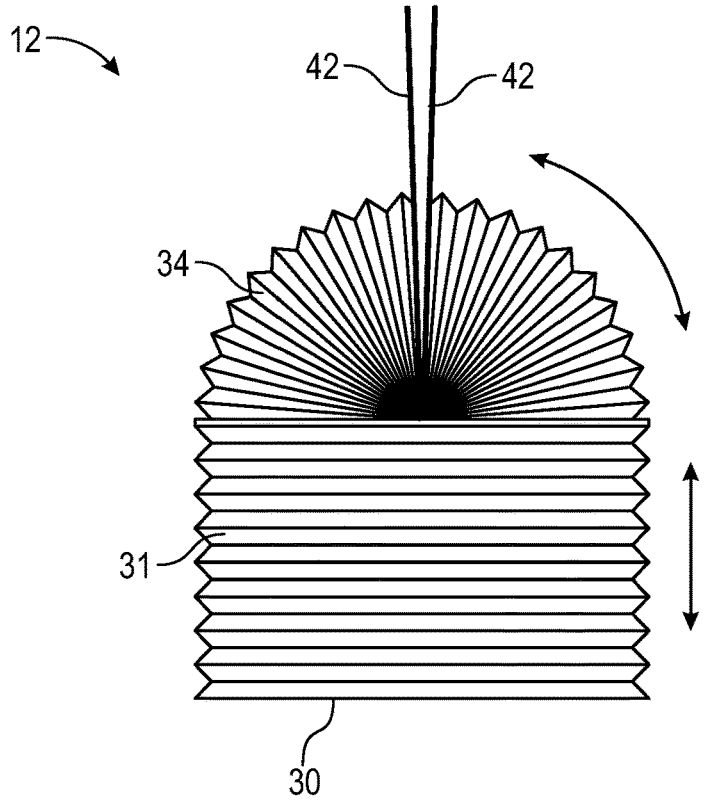
FIG. 7 illustrates a front view of the container in which both the first accordion-pleated walls and the second accordion-pleated walls are in expanded state, in accordance with one embodiment of the present invention.
Figure 8:
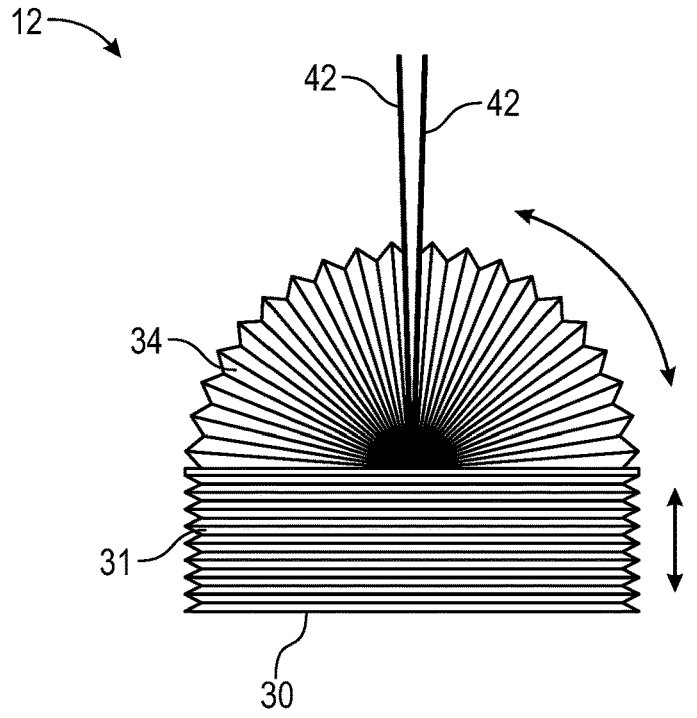
FIG. 8 illustrates a front view of the container in which the first accordion-pleated walls are in collapsed state and the second accordion-pleated walls are in expanded state, in accordance with one embodiment of the present invention.

Now referring to FIGS. 7 through 11, operation of container 12 is explained, in accordance with one exemplary embodiment of the present invention. FIG. 7 shows a front view of container 12 i.e., first accordion-pleated walls 31 in an expanded state. A person skilled in the understands that FIG. 7 shows an exemplary scenario in which both first accordion-pleated walls 31 and second accordion-pleated walls 34 are in expanded state. In the expanded state, first accordion-pleated walls 31 expand and allow storing food product in interior 38. Here, user 14 applies force to expand first accordion-pleated walls 31 to increase the space of interior 38 depending on the size or amount of food products 46 that need to be stored in interior 38. Further, second accordion-pleated walls 34 come closer and allow closing of opening 40 while also allowing handles 42 to be used for holding and transporting container 12. As presented above, ridges 32 and troughs 33 allow folding of first accordion-pleated walls 31 under the action of a substantially vertical force. When needed, user 14 applies substantial force vertically to bring first accordion-pleated walls 31 from expanded state to a collapse state. FIG. 8 shows a front view of container 12 i.e., first accordion-pleated walls 31 in the collapse state. In the collapse state, first accordion-pleated walls 31 fold thereby reducing its height.

In one exemplary embodiment, each of first accordion-pleated walls 31 and second accordion-pleated walls 32 are provided with a self-supporting mechanism (not shown). The self-supporting mechanism has a suitable shape and is made of suitable material such that each of first accordion-pleated walls 31 and second accordion-pleated walls 32 can hold any selected position between a collapsed and a fully expanded position(s) without requiring an applied downward force. The self-supporting mechanism allows each of first accordion-pleated walls 31 and second accordion-pleated walls 32 to retain their respective position until a substantial force is exerted (vertically) to expand or collapse container 12. Examples of the self-supporting mechanism include, but not limited to, straps, hook and loops, adhesive tape, etc. The self-supporting mechanism operates without affecting the shape, material and/or functionality of first accordion-pleated walls 31 and second accordion-pleated walls 32.

Figure 9:
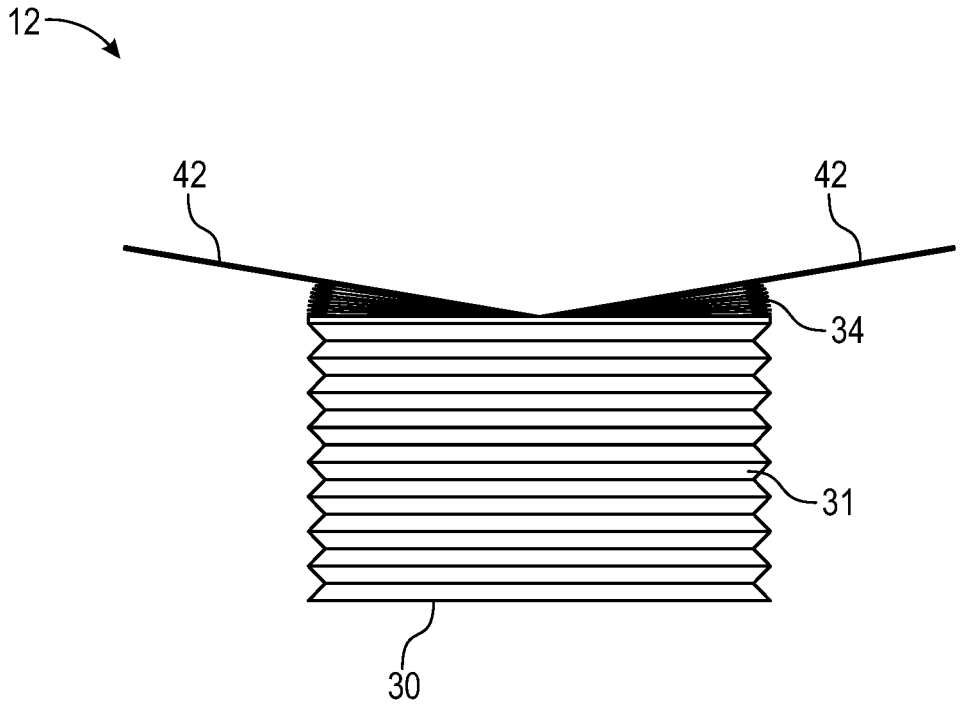
FIG. 9 illustrates a front view of the container in which the first accordion-pleated walls are in expanded state and the second accordion-pleated walls are in collapsed state, in accordance with one embodiment of the present invention.
Figure 10:
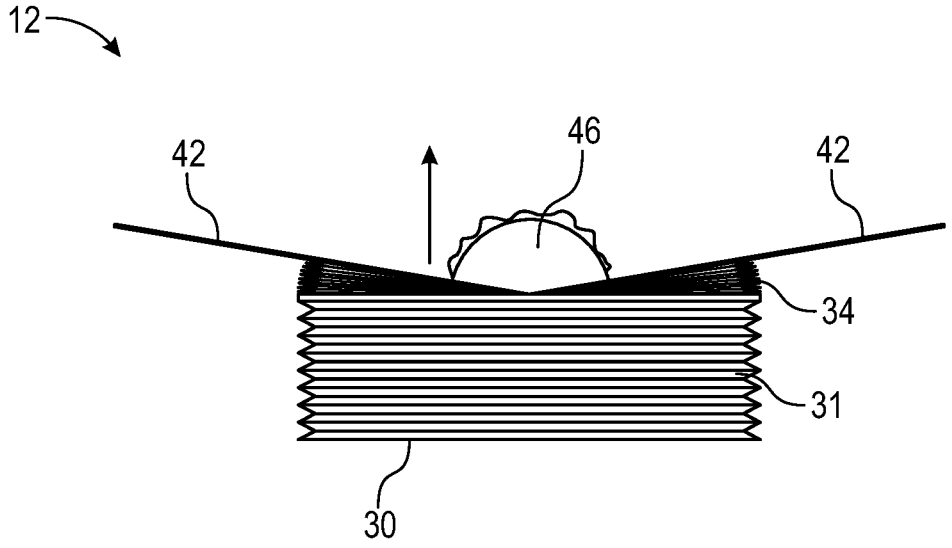
FIG. 10 illustrates a front view of the container in which both the first accordion-pleated walls and the second accordion-pleated walls are in collapsed state, in accordance with one embodiment of the present invention.
Figure 11:
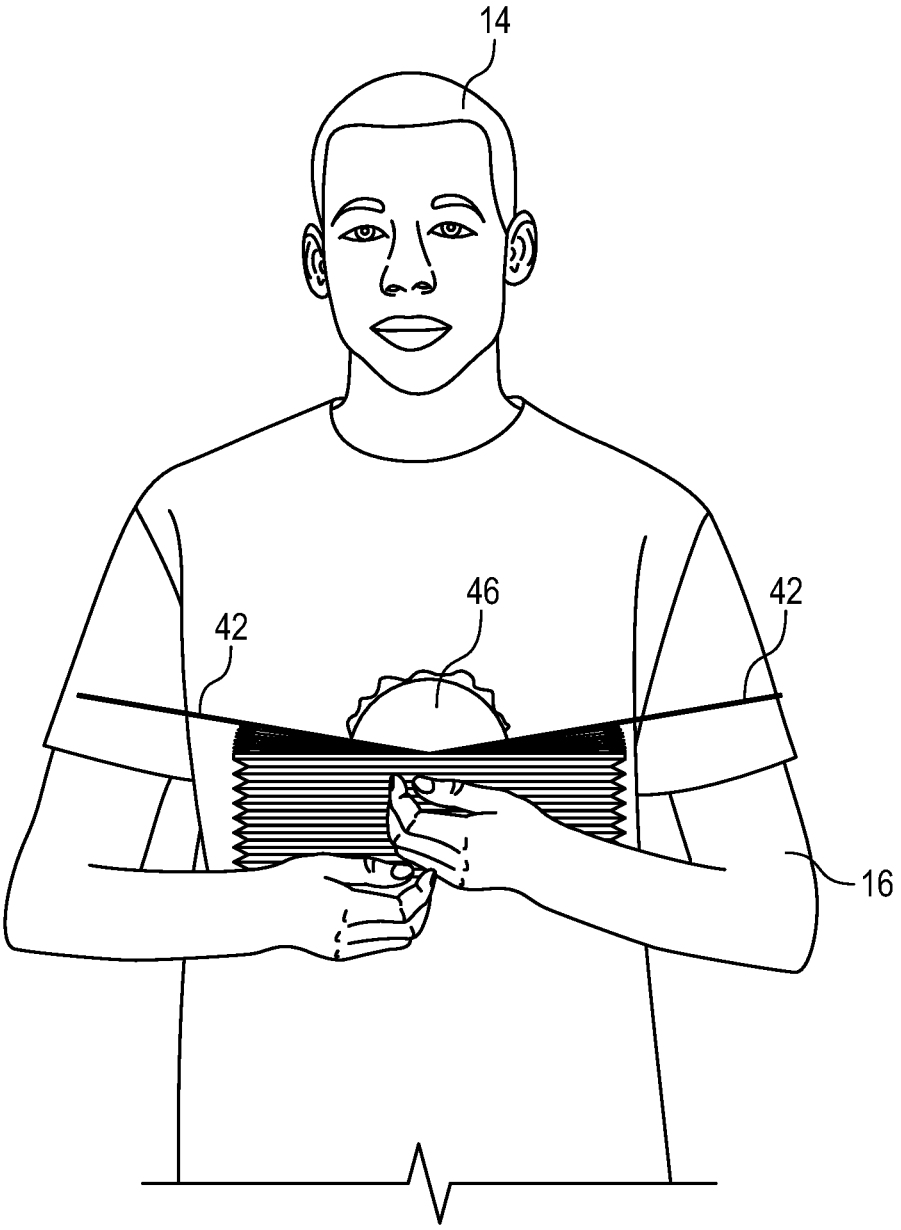
FIG. 11 illustrates a user consuming a food product holding the container, in accordance with one exemplary embodiment of the present invention.

Further, FIG. 9 shows a front view of container 12 i.e., second accordion-pleated walls 34 in folded/collapse state and first accordion-pleated walls 31 in expanded state. In the folded/collapse state, second accordion-pleated walls 34 collapse and provide access to interior 38 through opening 40. Consider that interior 38 stores a food product 46. Examples of food products 46 include, but not limited to, a burger, a sandwich, cut fruit, fruit, vegetable, etc. When both first accordion-pleated walls 31 and second accordion-pleated walls 34 are in folded/collapse state, user 14 applies force such that food product 46 comes out through opening 40, as shown in FIG. 10. As food product 46 comes out through opening 40, user 14 holds at sides 24 of container 12 with one hand and consumes food product 46 without touching food product 46. FIG. 11 shows an exemplary embodiment, in which user 14 consumes food product 46 while holding first accordion-pleated walls 31 of container 12.

A person skilled in the art understands that user 14 collapses second accordion-pleated walls 34 such that opening 40 provides minimum or sufficient area to bring out food product 46 from interior 38. Here, food product 46 remains in interior 38 while being exposed partially and ensures food product 46 does not fall off from container 12. For instance, user 14 applies force to collapse first accordion-pleated walls 31 only to expose food product 46 partially. As user 14 consumes food product 46, user 14 applies more force to completely collapse first accordion-pleated walls 31 to consume the remaining portion of food product 46. Similarly, user 14 adjusts second accordion-pleated walls 34 to adjust the size of opening 40 to provide access to interior 38. By adjusting first accordion-pleated walls 31 and second accordion-pleated walls 34, any drippings from food product 46 are made to fall within interior 38 or on liner 44. Once liner 44 gets dirty, liner 44 is removed or cleaned and put back or disposed of depending on the need.

Container 12 stores food product 46 and prevents food product 46 from falling apart while carrying it around. When user 14 wishes to consume food product 46, then user 14 adjusts first accordion-pleated walls 31 and expands second accordion-pleated walls 34 and consumes food product 46 straight out of container 12 in an easy manner. This ensures food product 46 is held from outside of container 12 while ensuring hands 16 of user 14 are clean. User 14 holds container 12 with one or more hands 16 depending on need or comfort of user 14.

After use (or after consuming food product 46), user 14 expands/collapses first accordion-pleated walls 31 and expands second accordion-pleated walls 34 to hold handles 42 and transport container 12, and act as a trash receptacle as shown in FIG. 1, for example.

Based on the above, it is evident that the presently disclosed container or package box can be used to store food product(s) and consume the food product. The presently disclosed container can be used at home, office, or while on a motorcycle or even in a vehicle, such as a car. The container can be used as a food package that facilitates eating while in a motor vehicle or on the go or by an office desk. The user can easily adjust and push up the food product while eating. The presently disclosed container allows for easy transport and disposal. The presently disclosed container can be connected to any other object. For example, the handles can be connected to an object in a car while driving. When needed, the user can remove the handle, adjust the accordions with one hand and consume the food product, while using another hand for driving the car.

A person skilled in the art appreciates that the container may come in a variety of shapes and sizes depending on the need and comfort of the user. Further, many changes in the design and placement of components may take place without deviating from the scope of the presently disclosed container.

In the above description, numerous specific details are set forth such as examples of some embodiments, specific components, devices, methods, in order to provide a thorough understanding of embodiments of the present invention. It will be apparent to a person of ordinary skill in the art that these specific details need not be employed, and should not be construed to limit the scope of the invention.

In the development of any actual implementation, numerous implementation-specific decisions must be made to achieve the developer's specific goals, such as compliance with system-related and business-related constraints. Such a development effort might be complex and time-consuming, but may nevertheless be a routine undertaking of design, fabrication, and manufacture for those of ordinary skill. Hence as various changes could be made in the above constructions without departing from the scope of the invention, it is intended that all matter contained in the above description or shown in the accompanying drawings shall be interpreted as illustrative and not in a limiting sense.

The foregoing description of embodiments is provided to enable any person skilled in the art to make and use the invention. Various modifications to these embodiments will be readily apparent to those skilled in the art, and the novel principles and invention disclosed herein may be applied to other embodiments without the use of the innovative faculty. It is contemplated that additional embodiments are within the spirit and true scope of the disclosed invention.

What is claimed is:

1. A container, comprising:

a base;

first accordion-pleated walls, wherein said first accordion-pleated walls extend from said base and form an interior with said base; and second accordion-pleated walls, wherein said second accordion-pleated walls extend from said first accordion-pleated walls, and wherein said second accordion-pleated walls comprise an opening, wherein said first accordion-pleated walls expand or collapse under the action of a substantial force on said first accordion-pleated walls, wherein said second accordion-pleated walls expand or collapse under the action of a substantial force on said second accordion-pleated walls, wherein said first accordion-pleated walls receive a food product into said interior through said opening, wherein said first accordion-pleated walls expand or collapse while storing said food product in said interior, and said second accordion-pleated walls expand to retain said food product within said interior, wherein said second accordion-pleated walls collapse, and wherein said first accordion-pleated walls collapse under the action of the substantial force to push said food product for consumption by a user through said opening from said interior.

2. The container of claim 1, wherein said first accordion-pleated walls comprise a series of ridges and troughs to collapse and expand said first accordion-pleated walls.

3. The container of claim 2, wherein said ridges are spaced apart equally, and wherein said troughs are spaced apart equally.

4. The container of claim 1, wherein said second accordion-pleated walls comprise ridges and troughs to collapse and expand said second accordion-pleated walls.

5. The container of claim 4, wherein said ridges are spaced apart equally, and wherein said troughs are spaced apart equally.

6. The container of claim 1, wherein said first accordion-pleated walls form a substantially rectangular configuration, and wherein said second accordion-pleated walls form a substantially semi-circular configuration.

7. The container of claim 1, further comprising a center blade to hold food in place.

8. The container of claim 1, wherein said container may be held and operated with one hand by a user.

9. The container of claim 1, wherein said second accordion-pleated walls provide a fit around the face of a user while eating to catch food.

10. The container of claim 1, wherein said second accordion-pleated walls angle around a users face to leave minimal open space between a users face and said second accordion-pleated walls.

11. The container of claim 1, wherein said second accordion-pleated walls comprise handles, and wherein said handles extend from said second accordion-pleated walls and allow to transport said container.

12. The container of claim 11, wherein said handles seal and may reseal the food inside said container.

13. The container of claim 12, wherein each of said handles comprises a liner.

14. The container of claim 13, wherein said liner removably connects to said handle.

15. The container of claim 1, further comprises self-supporting mechanisms, wherein said self-supporting mechanisms connect to said first accordion-pleated walls and said second accordion-pleated walls, and wherein said self-supporting mechanisms help said first accordion-pleated walls and said second accordion-pleated walls to hold in collapsed and expanded position without requiring an applied force.

16. The container of claim 15, wherein said self-supporting mechanisms include one of straps, hook and loops, and an adhesive tape.

17. A method of providing a container, said method comprising the steps of:

providing a base;

providing first accordion-pleated walls extending from said base, said first accordion-pleated walls forming an interior with said base; and providing second accordion-pleated walls extending from said first accordion-pleated walls, said second accordion-pleated walls comprising an opening, configuring said first accordion-pleated walls for expanding or collapsing under the action of a substantial force on said first accordion-pleated walls;

configuring said second accordion-pleated walls for expanding or collapsing under the action of a substantial force on said second accordion-pleated walls;

receiving a food product into said interior through said opening, expanding or collapsing said first accordion-pleated walls while storing said food product in said interior;

expanding said second accordion-pleated walls for retaining said food product within said interior;

collapsing said second accordion-pleated walls; and collapsing said first accordion-pleated walls under the action of the substantial force for pushing said food product for consumption by a user through said opening from said interior.

18. The method of claim 17, further comprising providing handles extending from said second accordion-pleated walls, said handles allowing transport of said container.

19. The method of claim 18, further comprising providing a liner at said handle.

20. The method of claim 17, further comprising providing self-supporting mechanisms connecting said first accordion-pleated walls and said second accordion-pleated walls, said self-supporting mechanisms configured for holding respective said first accordion-pleated walls and said second accordion-pleated walls in collapse and expand position without requiring an applied force.

* * * * *